United States Patent [19]

Lisiecki

[11] 4,318,479

[45] Mar. 9, 1982

[54] LIQUID CONTAINER WITH STRAW OPENING MEANS

[75] Inventor: Robert E. Lisiecki, Orchard Lake, Mich.

[73] Assignee: Ex-Cell-O Corporation, Troy, Mich.

[21] Appl. No.: 144,132

[22] Filed: Apr. 28, 1980

[51] Int. Cl.[3] ..... B43M 7/00; B65D 3/26; B65D 5/72

[52] U.S. Cl. ..... 206/633; 229/7 S; 229/17 G; 229/17 R; 206/613

[58] Field of Search ..... 206/612, 607, 633, 613, 206/615; 229/17 G, 17 R, 7 S, 176

[56] References Cited

U.S. PATENT DOCUMENTS

| | | | |
|---|---|---|---|
| 3,770,185 | 11/1973 | Reeves | 229/17 G |
| 3,853,261 | 12/1974 | Moore | 206/612 |
| 4,244,474 | 1/1981 | Wise | 229/17 G |

*Primary Examiner*—George T. Hall
*Attorney, Agent, or Firm*—John P. Moran

[57] ABSTRACT

The accompanying description and drawings disclose a liquid carrying paperboard carton having straw opening means formed in a side wall panel thereof. The straw opening means includes a tear strip formed by cuts through the carton wall beginning at the edge of the side panel adjacent the usual underlying fifth panel. A tab is formed from material available from the adjacent blank during the scoring and cutting process, and serves as an extension of the tear strip. The formation of the tab automatically provides a cut-out portion on the edge of the side seam flap of the adjacent blank while being cut from a roll of paperboard, thus providing an opening for a straw hole when the tear strip of a completed container is peeled back from the underlying fifth panel.

7 Claims, 8 Drawing Figures

LIQUID CONTAINER WITH STRAW OPENING MEANS

TECHNICAL FIELD

This invention relates generally to liquid carrying paperboard cartons or containers, and, more particularly, to such containers provided with improved means for readily forming an opening for inserting a straw therein.

It is essential that liquid carrying paperboard containers reach the consumer in a convenient, safe and sanitary condition, and also be capable of retaining such sanitary condition while being handled, and the contents thereof consumed, by schoolchildren and adults alike. Where straw opening means are provided on such containers, such means must also measure up to the convenience, safety and sanitation requirements.

BACKGROUND ART

U.S. Pat. No. 3,770,185 provides for a straw opening means wherein parallel score lines are cut from one side and a circular score line is cut from the opposite side of one vertical wall above the gable, each to a depth of from 40 to 75 percent of the wall thickness. Such score lines form a tear strip extending from the upper vertical edge, along the width of the vertical wall and onto one gable. A "thumb notch" is formed on the uppermost edge of the other vertical wall to facilitate the opening process. Once the tear strip is torn away along the lines defined by the parallel score lines, a plug of material encompassed by the circular score line remains intact with the tear strip to expose a hole for receiving a straw.

U.S. patent application, Ser. No. 47,658, provides for a straw opening means wherein spaced apart score lines are formed to extend laterally from the edge of a conventional gable top roof panel lying adjacent the panel interconnecting-side seam flap, to a depth of at least halfway through the paperboard, forming a tear strip such that when the tear strip is peeled or torn away past the free edge of the side seam panel, a weakened area is exposed which may be penetrated by the pressing of a straw thereagainst. In one embodiment, an extended tab is formed by notching the side seam panel of an adjacent carton blank in the cut-off operation from a paperboard roll.

DISCLOSURE OF INVENTION

An object of the invention is to provide a liquid carrying container including improved means for readily forming a sanitary straw opening therein without having to open a pouring spout.

Another object of the invention is to provide a liquid carrying, paperboard container including an improved straw opening means associated with a side wall, rather than with a conventional gable top.

A further object of the invention is to provide a liquid proof, thermoplastic coated paperboard container including a tear strip formed integral with the first side panel and adjacent the edge thereof which overlies the conventional, narrow fifth panel or side seam flap.

Still another object of the invention is to provide a plastic coated, flat top type container including straw opening means consisting of a tear strip formed on the side seam-supported edge of one side panel by spaced laterally-extending die cuts formed all the way through the paperboard layer, and extending from a side edge of the panel, laterally across a portion of the width of the underlying side seam, thus defining a flexible hinge between the ends of the die cuts when the tear strip is peeled back from the edge of the panel.

A still further object of the invention is to provide a container with such straw opening means and, additionally including a notched or arcuate shaped opening formed along the free edge of the side seam flap at a location intermediate the die cuts so as to form an opening adaptable to having a straw inserted therethrough once the tear strip is peeled back to the flexible hinge.

A still further object of the invention is to provide a container with such straw opening means wherein a tab is formed on an edge of the adjacent carton blank by virtue of the formation of the notched or arcuate shaped opening in the side seam when adjacent blanks are being cut from a paperboard roll.

An even further object of the invention is to provide a container with a side panel straw opening means consisting of a notched opening and cooperating tear strip with tab, but wherein the tab, in one embodiment, extends beyond the edge of the carbon and, in an alternate embodiment, does not extend beyond the edge.

These and other objects and advantages of the invention will be apparent when reference is made to the following description and accompany drawings:

BEST MODE FOR CARRYING OUT THE INVENTION

Figure 1:
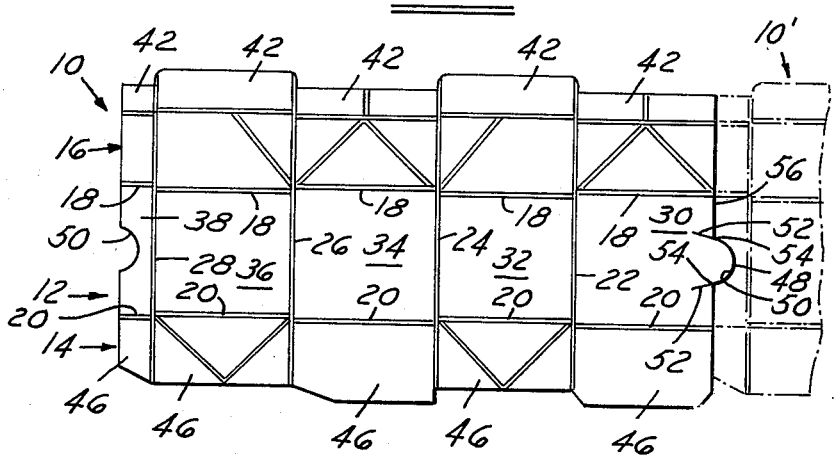
FIG. 1 is a layout view of a blank from which a container embodying the invention may be erected, showing the inside surface thereof and illustrating its relationship to an adjacent blank in the cut-off operation.

Referring now to the drawings in greater detail, FIG. 1 illustrates a paperboard blank 10 formed from kraft paperboard. The paperboard is covered on both sides with a suitable thermoplastic material, such as polyethylene, in order to render a container formed from the paperboard fluid-tight and capable of holding such acidic liquids as milk.

The container blank 10 includes a body portion 12 which, in the present instance, is substantially square in cross section. At its base the body portion 12 is provided with a suitable bottom end closure portion 14. The upper end of the body portion 12 is provided with a suitable flat top end closure portion 16.

Figure 2:
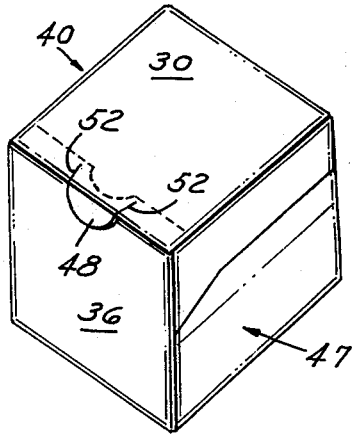
FIG. 2 is a perspective view of a closed and sealed paperboard container embodying the invention.

The flat blank 10 is formed of high-grade paperboard coated with outer and inner layers of polyethylene thermoplastic material. By means of an appropriate pattern of score lines, the blank 10 is divided into a plurality of panels and sections which are utilized for the walls of a container and the top and bottom closure parts when the container is erected therefrom. The central or body portion 12 of the blank 10 becomes the body of the container and is defined by spaced apart transverse score lines 18 and 20, running in substantially parallel relation across the face of the blank. Intersecting the lines 18 and 20 at spaced intervals therealong are a series of perpendicular score lines 22, 24, 26 and 28, which define, in the central and major area of the blank, side or wall panels 30, 32, 34 and 36 together with a fractional side or wall panel or side seam flap 38, sometimes referred to as the fifth panel. When a container 40 (FIG. 2) is erected, the side seam flap 38 is adhesively secured in overlying relation with the side panel 30.

It should be noted that the transverse score lines 18 and 20 are not continuous but are formed in staggered portions interrupted by the perpendicular score lines 22, 24, 26 and 28. The purpose of this staggered scoring is to accommodate the thickness of the paper as the paper is bent along the score lines when the container is erected and thus prevent crowding of the paper at the various junctions of the score lines. This not only enhances the strength and appearance of the finished container but facilitates its erection and closure by automatic machinery.

Integral with the upper ends of the side panels, but separated therefrom by the transverse score line 18, are a plurality of panel extensions 42 which are foldable into a flat top configuration. This may be accomplished in any known manner. As one example, it may be formed initially as a conventional gable top, and then folded into a flat top closure 44 (FIG. 3), as illustrated and described in U.S. Pat. No. 3,869,078, incorporated herein by reference, but forming no part of the present invention.

Integral with the bottom ends of the side panels, but separated therefrom by the transverse score line 20, are a plurality of panel extensions 46 which are foldable into a flat bottom closure (not shown). This may be completed in any suitable known configuration, as, for example, the bottom closure arrangement 47 (FIG. 2), as illustrated and described in U.S. Pat. No. 3,120,335, incorporated herein by reference, but forming no part of the present invention.

Referring once again to FIG. 1, it may be noted that an arcuate-shaped tab 48 is formed at the center of the side panel 30 of the blank 10. The formation of each tab 48 produces an arcuate-shaped notch 50 in the side seam panel 38, of the adjacent blank 10', inasmuch as the individual blanks are cut from a continuous paperboard roll. A pair of spaced apart cuts 52 are formed in the side panel 30, extending laterally in FIG. 1 from the junctures 54 of the tab 48 with the edge 56 of the panel 30. The cuts 52 are made completely through the paperboard and extend from the edge 56 a distance which is a predetermined amount less than the width of the side seam panel 38 for a purpose to be described.

Once the container 40 is formed from the blank 10 it is apparent that the tab 48 is able to be folded around the corner of the container onto the side panel 36 so as to not interfere with stacking and shipping. Then, when manually lifted from the panel 36 and peeled back from the underlying side seam panel 38, to which it is sealed during the construction process, the tab 48 and resultant tear strip 58 (FIG. 3) terminate before reaching the inner exposed edge of the side seam panel 38, forming a flexible hinge with the latter.

Figure 3:
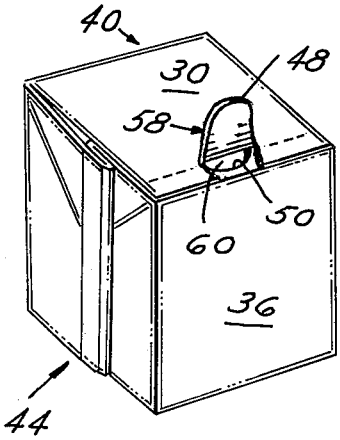
FIG. 3 is a perspective view of the FIG. 2 container with the tear strip shown in an open condition.

As shown in FIG. 3, such peeling back of the tear strip 58 exposes the notch 50, forming an opening 60 adaptable to having a straw extended therethrough. Hence, the need for a gable top and typical pour spout on a container, such as a milk carton, is eliminated. This is particularly applicable to half-pint and/or small cross-section carton sizes.

Figure 1A:
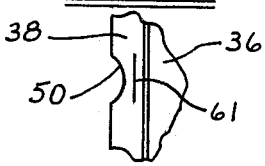
FIG. 1A is a fragmentary view of a modified portion of the FIG. 1 structure.

In the event the tear strip 58 does not peel cleanly from the underlying side seam panel 38 to expose the opening 60, it may be desirable to form a slit 61 through the thermoplastic coating, intermediate the notch 50 and the score line 28, as shown in FIG. 1A. This has been found to enhance a clean opening operation.

It's apparent that, since there is no conventional top pouring spout required, the panel 30, formerly referred to as a side panel, may now serve as a top panel, and the inked printing may be formed on the various panel surfaces accordingly.

Figure 4:
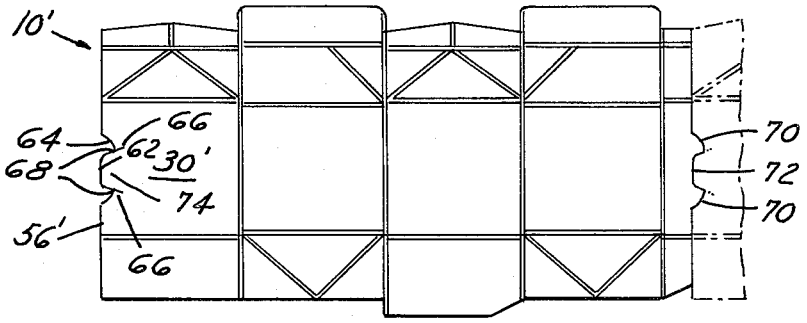
FIG. 4 is a layout view of a blank from which a container embodying an alternate embodiment of the invention may be erected.
Figure 5:
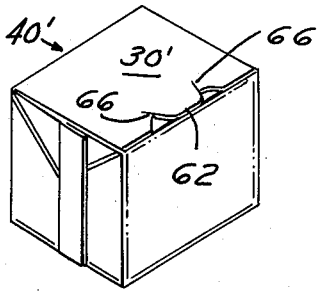
FIG. 5 is a perspective view of a closed and sealed paperboard container formed from the blank of FIG. 4.

In the alternate embodiment shown in FIGS. 4 and 5, a tab 62 is formed on the blank 10' so as to extend from a recessed section 64 of the panel 30', but not beyond the edge 56' thereof. Spaced apart cuts 66 extend from the respective ends 68 of the tab 62 in the manner described above relative to the spaced cuts 52. The formation of the recessed section 64 produces the matching arcuate-shaped extensions 70 and intermediate recessed portion 72, as shown in FIG. 4.

When the container 40' is completely erected, the tab 62 is adapted to facilitate the peeling-back process without extending beyond the edge of the carton, and the tear strip 74 will cooperate with the cut-out 72 to form an opening for the insertion therethrough of a straw in the manner described above for the FIG. 3 structure.

Figure 7:
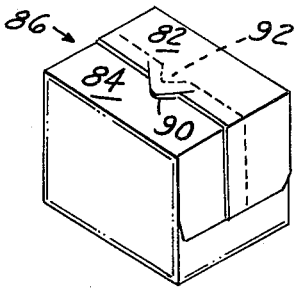
FIG. 7 is a perspective view of a closed and sealed paperboard container formed from the blank of FIG. 6.
Figure 6:
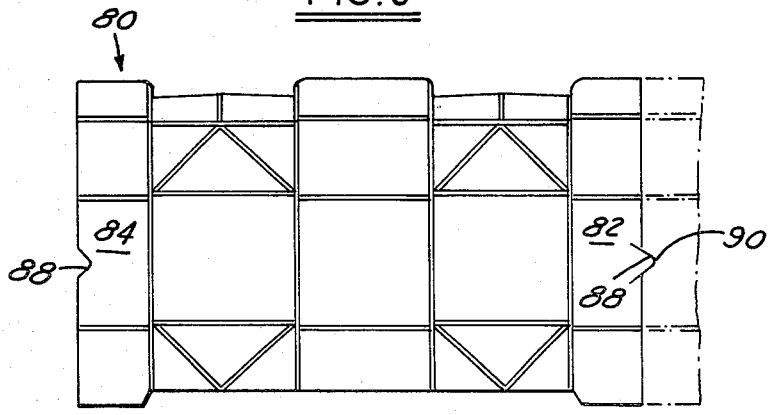
FIG. 6 is a layout view of a blank from which a container embodying another alternate embodiment of the invention may be erected.

In the alternate embodiment shown in FIGS. 6 and 7, it may be noted that the blank 80 of FIG. 6 includes first and fifth side wall panels 82 and 84 which are of such predetermined widths that a so-called "center side seam" type container 86 (FIG. 7) is produced by the conventional forming and sealing of the blank 80. As illustrated, the cut-out 88 and resultant tab 90 cooperate to provide a straw hole opening 92 substantially in the center of the container top panel formed by the sealing together of the overlapped panels 82 and 84.

Industrial Applicability

It should be apparent that the invention provides a novel, efficient and sanitary means for facilitating the use of a straw with a liquid carrying carton, without having to open the conventional pouring spout thereof. The above described arrangements would be applicable to blanks which are mirror images of the blanks 10, 10' and 80.

It should also be apparent that an abhesive or sealing inhibitor may be utilized in conjunction with the above described tab formations for facilitating the manual opening process to expose the straw opening formed by the notch in the underlying panel of the usual two overlapped and sealed panels.

While but three embodiments of the invention have been shown and described, other modifications thereof are possible.

The embodiments of the invention in which an exclusive property or privilege is claimed are defined as follows:

1. In a liquid carrying paperboard container coated overall with a thermoplastic material that serves as a barrier and becomes an adhesive when subjected to heat, and including a tubular body having four walls wherein one wall includes overlapped and sealed panels and serves as the top of the container, and flat end closures formed on opposite ends of said tubular body, the improvement comprising means for forming a straw opening in said tubular body intermediate said flat end closures and including a tear strip formed by cuts through the outer one of said overlapped panels along a pair of spaced apart lines beginning at the edge thereof adjacent the underlying panel of said overlapped panels and extending in a predetermined configuration a predetermined distance from the edge, a tab formed as an extension of said tear strip, with the inner ends of said pair of spaced apart lines defining a flexible hinge therebetween when said tear strip is peeled from said underlying panel, and a notch formed in the free edge of said underlying panel aligned with and adjacent to said tear strip to provide a straw hole opening when said tear strip is peeled back from said underlying panel.

2. The improvement in a liquid carrying paperboard container described in claim 1, wherein said tab extends beyond said edge of said one wall and is foldable onto said adjacent wall.

3. The improvement in a liquid carrying paperboard container described in claim 1, wherein said tab is formed on a recessed edge portion of said one wall and, hence, does not extend beyond said edge of said one wall.

4. The improvement in a liquid carrying paperboard container described in claim 1, wherein said fifth panel is a narrow underlying side seam flap.

5. The improvement in a liquid carrying paperboard container described in claim 1, wherein said first and fifth panels are narrower than each of said second, third and fourth panels, and overlap to form a center side seam type container.

6. The improvement in a liquid carrying paperboard container described in claim 1, and including a slit formed through the thermoplastic coating intermediate said notch and the adjacent wall edge.

7. A liquid carrying paperboard container comprising a tubular body formed of first, second, third, fourth and fifth panels, with said first and fifth panels being overlapped and secured to one another to form one wall panel, two oppositely disposed end closures, and straw opening means formed in said one wall panel, said tubular body being adapted to being filled in a vertical attitude through one of said end closures and then, after the sealing of said one of said end closures, rotated onto said third panel, thereby locating said one wall panel and, hence, said straw opening means in the uppermost position of the container when so rotated for the insertion of a straw therethrough.

* * * * *